US012760643B2

(12) United States Patent
AlTayyar et al.

(10) Patent No.: US 12,760,643 B2
(45) Date of Patent: Oct. 13, 2026

(54) WORKFLOW FOR PORE PRESSURE AND PERMEABILITY ESTIMATION IN UNCONVENTIONAL FORMATIONS

(71) Applicant: SAUDI ARABIAN OIL COMPANY, Dhahran (SA)

(72) Inventors: Tayyar Sulaiman AlTayyar, Dhahran (SA); Jose I. Rueda, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 499 days.

(21) Appl. No.: 18/466,582

(22) Filed: Sep. 13, 2023

(65) Prior Publication Data

US 2025/0084762 A1 Mar. 13, 2025

(51) Int. Cl.

| | |
|---|---|
| ***E21B 49/00*** | (2006.01) |
| ***E21B 43/16*** | (2006.01) |
| ***E21B 43/26*** | (2006.01) |

(52) U.S. Cl.

CPC ..... *E21B 49/008* (2013.01); *E21B 43/16* (2013.01); *E21B 43/26* (2013.01)

(58) Field of Classification Search

CPC ..... E21B 1/00–2200/22; G01V 1/00–2210/74
See application file for complete search history.

(56) References Cited

U.S. PATENT DOCUMENTS 4,353,249 A * 10/1982 Lagus ..... E21B 47/11 73/152.52
4,843,878 A 7/1989 Purfurst et al.
7,054,751 B2 * 5/2006 Craig ..... E21B 49/008 702/13
9,045,969 B2 * 6/2015 Waters ..... E21B 43/26
9,163,499 B2 * 10/2015 Adams ..... E21B 49/008
9,556,729 B2 * 1/2017 Lamei ..... G01N 15/08
9,790,788 B2 * 10/2017 Moos ..... E21B 49/008
9,945,224 B2 * 4/2018 Proett ..... E21B 47/06

(Continued)

OTHER PUBLICATIONS

King, Gregory, "3.2.2: Porosity from Well Logs," PNG 301: Introduction to Petroleum and Natural Gas Engineering, The Pennsylvania State University, from archive.org, captured Mar. 27, 2023 (Year: 2023).*

(Continued)

*Primary Examiner* — Judy Nguyen
*Assistant Examiner* — James Split
(74) *Attorney, Agent, or Firm* — Osha Bergman Watanabe & Burton LLP

(57) ABSTRACT

A method to perform a field operation of an unconventional reservoir is disclosed. The method includes performing a diagnostic fracture injection test (DFIT) of a formation zone in the unconventional reservoir to generate a DFIT dataset, where each log entry include a decline pressure and a time interval that are measured prior to any radial flow regime occurs in the formation zone during the DFIT, analyzing the DFIT dataset at selected time intervals to generate tabulated entries of estimated permeability versus estimated pressure in the tabulated entries, and determining, prior to said any radial flow regime occurs in the formation zone during the DFIT, a true reservoir permeability in the formation zone by extrapolating the tabulated entries of estimated permeability versus estimated pressure.

15 Claims, 7 Drawing Sheets

(56) References Cited

U.S. PATENT DOCUMENTS

| | | | | |
|---|---|---|---|---|
| 10,975,669 | B2 * | 4/2021 | El Kholy | E21B 41/005 |
| 11,608,740 | B2 * | 3/2023 | Moos | E21B 43/00 |
| 2015/0040657 | A1 | 2/2015 | Proett et al. | |

OTHER PUBLICATIONS

Barree, R.D. et al., "Holistic Fracture Diagnostics"; Proceedings of the Rocky Mountain Oil & Gas Technology Symposium; Paper No. SPE-107877-MS; pp. 1-13; Apr. 16, 2007 (13 pages).

Xue, Han et al., "Permeability Estimation from Fracture Calibration Test Analysis in Shale and Tight Gas"; Proceedings of the SPE/AAPG/SEG Unconventional Resources Technology Conference; Paper No. URTEC-1569587-MS; pp. 1-10; Aug. 12, 2013 (10 pages).

Yeager, Bryce B. et al., "Injection/Fall-off Testing in the Marcellus Shale: Using Reservoir Knowledge to Improve Operational Efficiency"; Proceedings of the SPE Eastern Regional Meeting; Paper No. SPE-139067-MS; pp. 1-19; Oct. 13, 2010 (19 pages).

Ewens, S. et al., "Executing Minifrac Tests and Interpreting After-Closure Data for Determining Reservoir Characteristics in Unconventional Reservoirs"; Proceedings of the SPE Canadian Unconventional Resources Conference; Paper No. SPE-162779-MS; pp. 1-14; Oct. 30, 2012 (14 pages).

Soliman, M.Y. et al., "After-Closure Analysis to Determine Formation Permeability, Reservoir Pressure, and Residual Fracture Properties"; Proceedings of the SPE Middle East Oil and Gas Show and Conference; Paper No. SPE-93419-MS; pp. 1-15; Mar. 12, 2005 (15 pages).

Liao, Lulu et al., "Diagnostic Fracture Injection Tests Analysis and Numerical Simulation in Montney Shale Formation"; Energies; vol. 15, Issue 23, Article 9094; pp. 1-18; Dec. 2022 (18 pages).

Xue, Han, "Permeability Estimation From Fracture Calibration Test Analysis in Shale and Tight Gas"; A thesis submitted to the Office of Graduate Studies of Texas A&M University in partial fulfillment of the requirements for the degree of Master of Science; Major Subject: Petroleum Engineering; pp. ii-119; Dec. 2012 (132 pages).

* cited by examiner

WORKFLOW FOR PORE PRESSURE AND PERMEABILITY ESTIMATION IN UNCONVENTIONAL FORMATIONS

BACKGROUND

An unconventional reservoir has hydrocarbons formed within the rock and never migrated, such as source rock and coal, or migrated as tight-sand, and oil-sand. These reservoirs contain enormous quantities of oil and natural gas but are challenging to produce economically on a commercial scale. In contrast, the conventional reservoir is a porous rock formation where hydrocarbons have migrated from a source rock. The unconventional reservoir typically has such low permeability that massive hydraulic fracturing is necessary to produce hydrocarbons. The unconventional reservoir is also referred to as a tight reservoir throughout this disclosure. Unconventional reservoirs around the world are characterized by very low permeability, with a rapid decline in production rates, leading to a relatively shorter well life.

Exploration and developing source rocks have been common in petroleum industry to facilitate development and production of unconventional reservoirs. One of the main challenges is the tightness of the rock where it reaches to permeability of nano-Darcy which limits the conventional method to estimate the main rock properties of permeability and pore pressure.

SUMMARY

In general, in one aspect, the invention relates to a method to perform a field operation of an unconventional reservoir. The method includes performing a diagnostic fracture injection test (DFIT) of a formation zone in the unconventional reservoir to generate a pressure and time data set from DFIT, wherein each entry of the DFIT dataset comprises a decline pressure with time that is analyzed to predict flow regimes, yielding estimates of formation-related properties such as: closure pressure, permeability, and reservoir pressure. In nano-Darcy range of permeability, direct estimation of reservoir permeability and pressure is extremely challenging and time consuming. On the other hand, closure pressure can be accurately estimated within an acceptable timeframe. Alternatively, by having estimates of closure pressure, the reservoir pressure can be calculated using the minimum horizontal stress equation. After that, the permeability is estimated using the Horner plot through the extrapolation of the curvature of pressure and superposition time.

In general, in one aspect, the invention relates to a pore pressure and permeability estimation system to facilitate a field operation of an unconventional reservoir. The pore pressure and permeability estimation system includes a computer processor and memory storing instructions, when executed by the computer processor comprising functionality for performing a diagnostic fracture injection test (DFIT) of a formation zone in the unconventional reservoir to estimate reservoir permeability and pressure using the dataset from DFIT, wherein each entry of the DFIT dataset comprises a decline pressure with time that is analyzed to estimate closure pressure, and apply the methodology to estimate reservoir permeability and pressure. In nano-Darcy range of permeability, direct estimation of reservoir permeability and pressure is extremely challenging and time consuming. On the other hand, closure pressure can be accurately estimated within an acceptable timeframe. Alternatively, by having estimates of closure pressure, the reservoir pressure can be calculated using the minimum horizontal stress equation. After that, the permeability is estimated using the Horner plot through the extrapolation of the curvature of pressure and superposition time.

In general, in one aspect, embodiments disclosed herein relate to a system that includes a well control system for performing a field operation of an unconventional reservoir, and a pore pressure and permeability estimation system comprising a computer processor and memory storing instructions. The instructions, when executed by the computer processor comprise functionality to estimate reservoir permeability and pressure using the dataset from DFIT of a formation zone in the unconventional reservoir, wherein each entry of the DFIT dataset comprises a decline pressure with time that is analyzed to estimate closure pressure, and apply the methodology to estimate reservoir permeability and pressure. In nano-Darcy range of permeability, direct estimation of reservoir permeability and pressure is extremely challenging and time consuming. On the other hand, closure pressure can be accurately estimated within an acceptable timeframe. Alternatively, by having estimates of closure pressure, the reservoir pressure can be calculated using the minimum horizontal stress equation. After that, the permeability is estimated using the Horner plot through the extrapolation of the curvature of pressure and superposition time.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a method and system for determining pore pressure and permeability estimation for unconventional formations. In particular, a diagnostic fracture injection test (DFIT) of a formation zone in an unconventional reservoir is performed to generate a DFIT dataset, where each entry of the DFIT dataset has a decline pressure with time that is analyzed to estimate closure pressure and to estimate reservoir permeability and pressure. The DFIT dataset is analyzed to estimate closure pressure and post-closure pressure decline. Accordingly, reservoir pressure is estimated using the minimum horizontal stress equation. Moreover, the true reservoir permeability in the formation zone is determined by extrapolating the tabulated entries of estimated permeability versus estimated pressure using Horner plot at different time intervals post-closure. Specifically, the true reservoir permeability in the formation zone is determined prior to any radial flow regime that might occur after fracture closure, which is extremely challenging and time consuming in unconventional reservoirs. In one or more embodiments of the invention, a ranking of formation zones in the unconventional reservoir is generated according to the true reservoir permeability in each of the formation zones in the case of vertical wells with multiple zones tested. A target formation zone having the true reservoir permeability meeting a predetermined criterion can then selected based on the ranking. Accordingly, a field production of the unconventional reservoir can be designed accounting for the true reservoir permeability and pressure of the target formation zone. For example, field operations may include a hydraulic fracturing operation.

Figure 1:
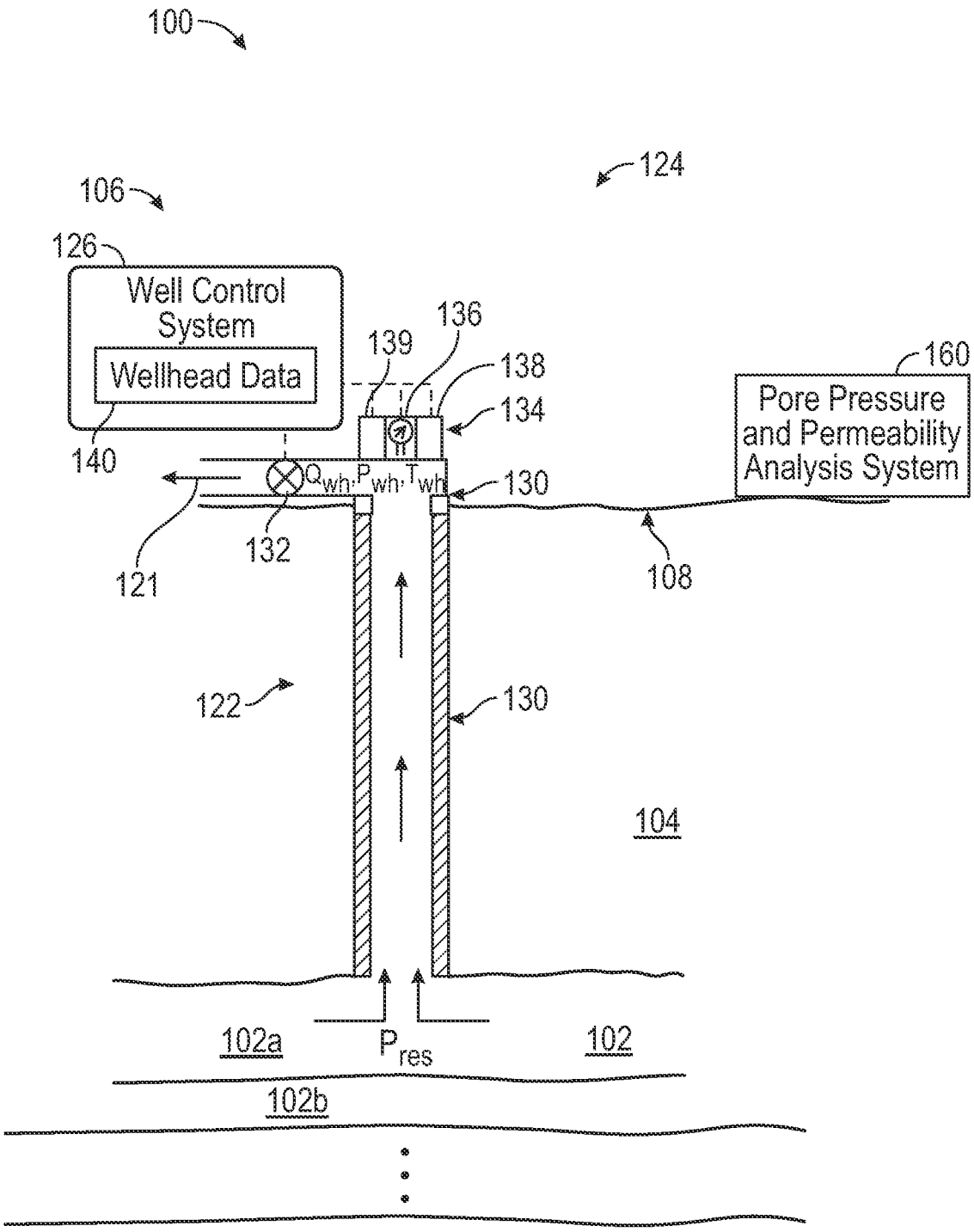
FIG. 1 shows a system in accordance with one or more embodiments.

FIG. 1 shows a schematic diagram in accordance with one or more embodiments. More specifically, FIG. 1 illustrates a field (100) that includes a hydrocarbon reservoir ("reservoir") (102) located in a subsurface hydrocarbon-bearing formation ("formation") (104) and a well system (106). The hydrocarbon-bearing formation (104) may include a porous or fractured rock formation that resides underground, beneath the Earth's surface ("surface") (108). In the case of the well system (106) being a hydrocarbon well, the reservoir (102) may include a portion of the hydrocarbon-bearing formation (104). In one or mor embodiments, the reservoir (102) is an unconventional reservoir. The hydrocarbon-bearing formation (104) and the reservoir (102) may include different layers of rock (referred to as formation layers, such as formation layers (102*a*, 102*b*, etc.)) having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

In some embodiments, the well system (106) includes a wellbore (120), a well sub-surface system (122), a well surface system (124), a well control system ("control system") (126) and a pore pressure and permeability analysis system (160). The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "down-hole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, the well sub-surface system (122) includes casing installed in the wellbore (120). For example, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In some embodiments, the casing includes an annular casing that lines the wall of the wellbore (120) to define a central passage that provides a conduit for the transport of tools and substances through the wellbore (120). For example, the central passage may provide a conduit for lowering logging tools into the wellbore (120), a conduit for the flow of production (121) (e.g., oil and gas) from the reservoir (102) to the surface (108), or a conduit for the flow of injection substances (e.g., water) from the surface (108) into the hydrocarbon-bearing formation (104). In some embodiments, the well sub-surface system (122) includes production tubing installed in the wellbore (120). The production tubing may provide a conduit for the transport of tools and substances through the wellbore (120). The production tubing may, for example, be disposed inside casing. In such an embodiment, the production tubing may provide a conduit for some or all of the production (121) (e.g., oil and gas) passing through the wellbore (120) and the casing.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing. In some embodiments, the well surface system (124) includes flow regulating devices that are operable to control the flow of substances into and out of the wellbore (120). For example, the well surface system (124) may include one or more production valves (132) that are operable to control the flow of production (121). For example, a production valve (132) may be fully opened to enable unrestricted flow of production (121) from the wellbore (120), the production valve (132) may be partially opened to partially restrict (or "throttle") the flow of production (121) from the wellbore (120), and production valve (132) may be fully closed to fully restrict (or "block") the flow of production (121) from the wellbore (120), and through the well surface system (124).

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature, and flow rate of production (121) flowing through the wellhead (130), or other conduits of the well surface system (124), after exiting the wellbore (120).

In some embodiments, the surface sensing system (134) includes a surface pressure sensor (136) operable to sense the pressure of production (121) flowing through the well surface system (124), after it exits the wellbore (120). The surface pressure sensor (136) may include, for example, a wellhead pressure sensor that senses a pressure of production (121) flowing through or otherwise located in the wellhead (130). In some embodiments, the surface sensing system (134) includes a surface temperature sensor (138) operable to sense the temperature of production (121) flowing through the well surface system (124), after it exits the wellbore (120). The surface temperature sensor (138) may include, for example, a wellhead temperature sensor that senses a temperature of production (121) flowing through or otherwise located in the wellhead (130), referred to as "wellhead temperature" ($T_{wh}$). In some embodiments, the surface sensing system (134) includes a flow rate sensor (139) operable to sense the flow rate of production (121) flowing through the well surface system (124), after it exits the wellbore (120). The flow rate sensor (139) may include hardware that senses a flow rate of production (121) ($Q_{wh}$) passing through the wellhead (130).

The control system (126) may control various field operations of the well system (106), such as well production operations, well injection operations, well completion operations, well maintenance operations, subsurface gas storage operations, and reservoir monitoring, assessment and development operations. In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well system (106), and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well system (106) to assess a current state of the well system (106) and make real-time decisions regarding development of the well system (106) and the reservoir (102), such as on-demand adjustments in regulation of production flow from the well. In some embodiments, the control system (126) includes a computer system that is similar to the computer system (400) described below with regard to FIG. 4 and the accompanying description.

In one or more embodiments of the disclosure, the reservoir (102) is an unconventional reservoir that is highly laminated with minimal communication between different stacked geological formation layers (e.g., layers (102*a*, 102*b*, etc.) even when they are adjacent to each other vertically. Some of these formation layers have higher oil/gas content and ability to produce compared to other formation layers in the reservoir. As a result, these formation layers deplete to different levels and oil remaining after primary production may be different in each formation layer. Further, oil remaining after primary production may also be different for different areas within a single formation layer. Throughout this disclosure, a particular area within a particular formation layer is referred to as a formation zone.

In some embodiments, the pore pressure and permeability analysis system (160) may include hardware and/or software with functionality for determining pore pressure and permeability of reservoir rocks with reduced testing time duration and ranking rock samples from various formation zones based on the determined rock permeability. A diagnostic fracture injection test (DFIT) is a pressure transient test conducted for ultra-low permeability shales to provide valuable information about the reservoir and to determine hydraulic fracture treatment parameters. During the DFIT, a relatively small volume of fluid is injected into the subsurface, creating a hydraulic fracture. After the end of injection, the pressure in the wellbore is monitored for hours or days. The DFIT pressure measurements are used to infer properties of the formation, including the leakoff coefficient, permeability, fracture closure pressure (which is related to the magnitude of the minimum principal stress and the net pressure), and formation pressure. Fracture closure pressure is the pressure at which a fracture closes after the leakoff of injected fluid into the formation. Throughout this disclosure, the term "closure" refers to the fracture closure. For example, the pore pressure and permeability analysis system (160) may store data from the DFIT of rock samples for performing closure analysis and after closure analysis. In one or more embodiments, the pore pressure and permeability analysis system (160) determines pore pressure and permeability of reservoir rocks using the method described in reference to FIG. 2 below. While the wellbore (120) is depicted as a vertical well in FIG. 1, the well environment (100) may include a deviated or horizontal well such as depicted in FIG. 3A below. While the pore pressure and permeability analysis system (160) is shown at a well site, embodiments are contemplated where the pore pressure and permeability analysis system (160) is located away from well sites. Further, the pore pressure and permeability analysis system (160) may include a computer system that is similar to the computer system (400) described below with regard to FIG. 4 and the accompanying description.

Figure 2:
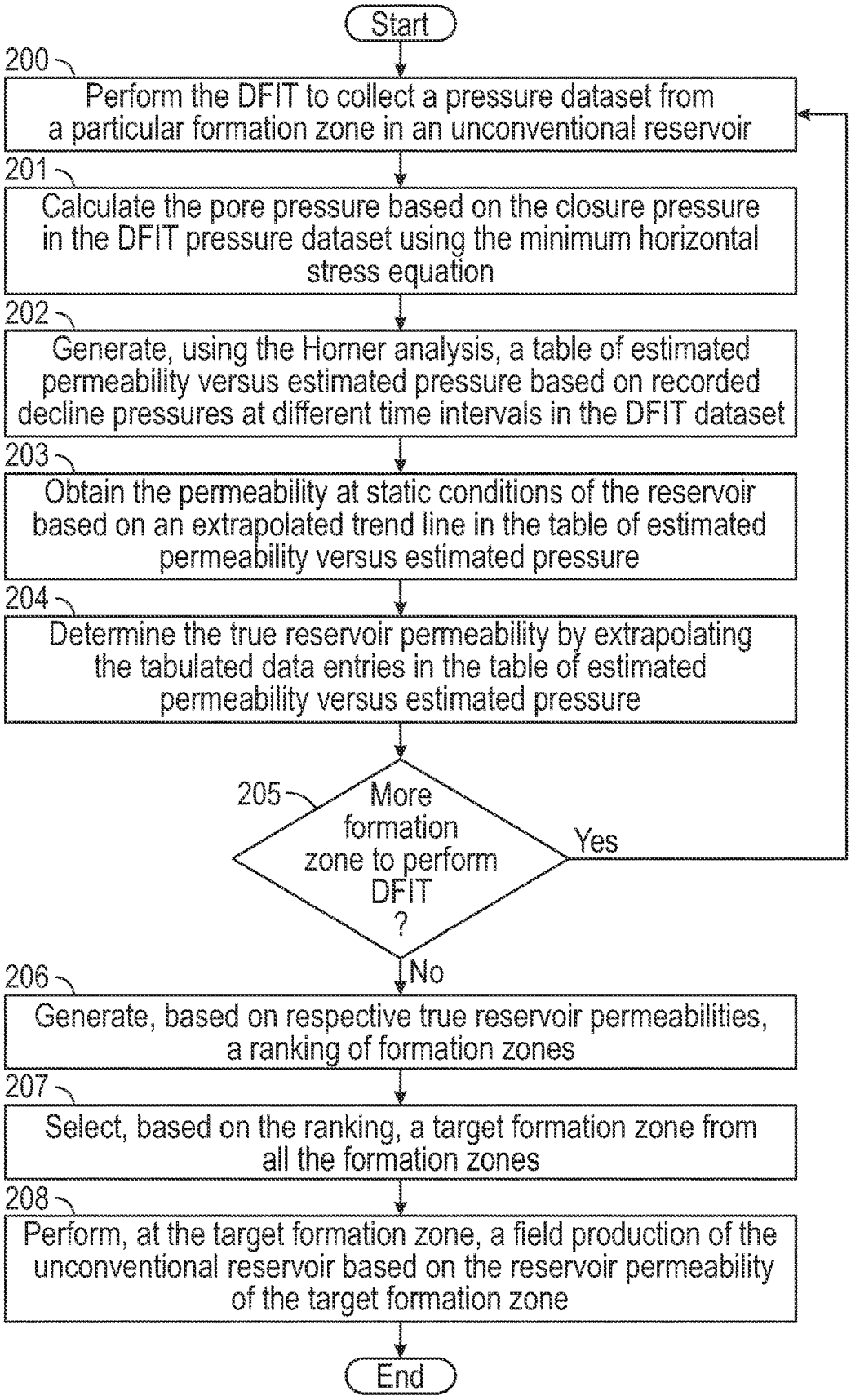
FIG. 2 shows a method flowchart in accordance with one or more embodiments.
Figure 3A:
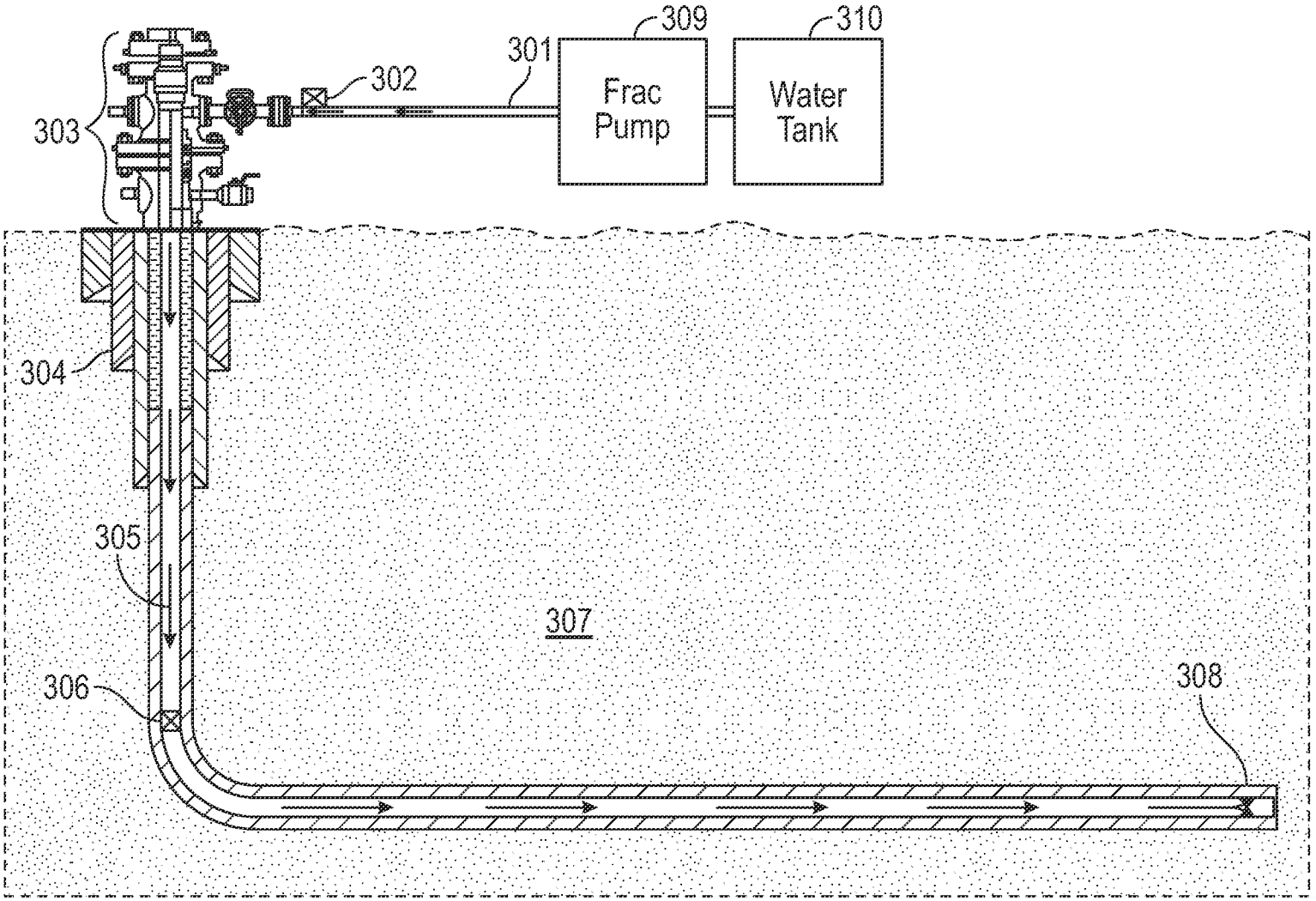
FIGS. 3A-3D show an example in accordance with one or more embodiments.

FIG. 2 shows a flowchart in accordance with one or more embodiments disclosed herein. Specifically, the flow chart illustrates a workflow to estimate the true reservoir pore pressure and permeability for nano-Darcy rocks at a significantly smaller timeframe. The workflow relates to reducing the time required for performing diagnostic fracture injection test (DFIT). DFIT utilizes two main analysis, i.e., the closure analysis (CA) to estimate closure pressure and fluid efficiency, and the after-closure analysis (ACA) to estimate pore pressure (denoted as Pp) and permeability (denoted as k). The DFIT process includes a small injection test to induce a fracture followed by a pressure decline monitoring phase (i.e., pressure falloff). Pressure measurements recorded during the pressure decline monitoring phase are referred to as recorded decline pressures. ACA is performed on the portion of the falloff data collected after the induced fracture closes. The pressure decline monitoring phase is the critical phase in estimating fracture and reservoir flow regimes. In particular, linear flow regime in fracture is identified for closure pressure identification, linear flow regime in formation is identified for estimating upper bound of reservoir pore pressure, and radial flow regime in formation is identified for estimating true reservoir pressure and permeability. Flow regime identification is sensitive to reservoir permeability, the higher the permeability the faster it is to reach and identify linear and radial flow regimes. However, as the permeability decreases to the range of nano-Darcy (nD), the flow regimes take longer time to occur (e.g., weeks to months) and in extreme cases, reaching the true radial flow regime becomes practically impossible.

To estimate the true reservoir pore pressure and permeability for nano-Darcy rocks at a significantly smaller timeframe, the workflow shown in FIG. 2 extends only to the time when closure pressure is observed and the linear flow regime starts, instead of relying on a full set of data that require up to months of data acquisition. In other words, the radial flow regime is excluded from the workflow shown in FIG. 2. Accordingly, this workflow significantly reduces the total monitoring time by as much as 95%. One or more of the steps in FIG. 2 may be performed using the components of the field (100), in particular the pore pressure and permeability analysis system (160) discussed above in reference to FIG. 1. In one or more embodiments, one or more of the steps shown in FIG. 2 may be omitted, repeated, and/or performed in a different order than the order shown in FIG. 2. Accordingly, the scope of the disclosure should not be considered limited to the specific arrangement of steps shown in FIG. 2.

Figure 3B:
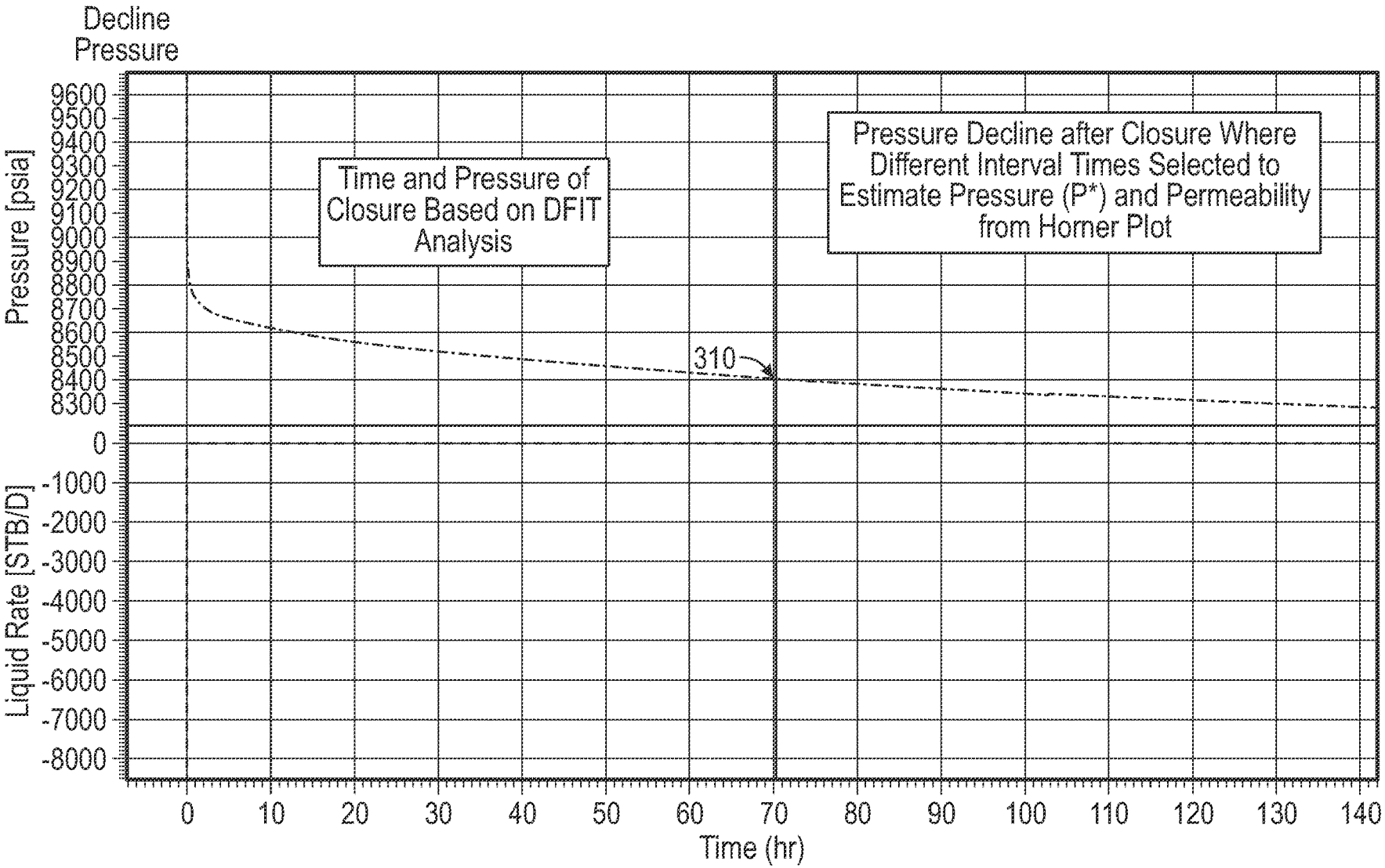

Initially in Step 200, the DFIT is performed to collect decline pressure data from a particular formation zone. For example, the DFIT may be performed at various depths in various wellbores throughout a region of interest across an unconventional reservoir. Due to the tight rocks in these formation zones, the DFIT may take several days to reach the closure during which the pressure measurements (referred to as post injection pressure decline or falloff pressure) are recorded for subsequent after closure analysis (ACA) to determine permeability/transmissibility and pore pressure. The recorded pressure decline is analyzed using closure analysis (CA) to evaluate and estimate closure pressure when the closure occurs. In one or more embodiments, the recorded pressure measurements are compiled into a DFIT dataset immediately after closure occurs and prior to any radial flow regime is reached. Each recorded decline pressure is paired with the corresponding monitoring time when the pressure measurement is made. Each pair of recorded decline pressure and the corresponding monitoring time is included in the DFIT dataset. FIG. 3A shows an example of recorded pressure measurements from beginning till immediately after closure during the DFIT of a fracturing injection operation. In particular, the DFIT dataset is compiled for each formation zone where the DFIT is performed. As shown in FIG. 3A, a fracturing pump (309) pumps fracturing fluid (e.g., treated water) from the water tank (310) through a fracturing line (301) and the wellhead (303) to enter the wellbore (305) with casings (304) and exit into the formation (307) via the perforation (308). Pressure measurements are obtained using the surface pressure gauge (302) and/or downhole pressure gauge (306). FIG. 3B shows an example decline pressure plot (300) where the vertical axis corresponds to decline pressure obtained from the pressure gauge and the horizontal axis corresponds to time. The closure pressure (310) shown in the plot (300) is determined based on DFIT analysis. In the right half of the plot (300) corresponds to the pressure decline after closure where different interval times are selected to estimate pressure and permeability from Horner plot. For example, the pressure measurements are used as pressure decline data in Step 202 to generate the Horner plot shown in FIG. 3C below.

In Step 201, the Minimum Stress Equation is applied to geomechanical properties estimated at early stage of drilling the well to find the pore pressure with a known closure pressure estimated from DFIT. In one or more embodiments, formation geo-mechanical properties are evaluated by using the well logs of the target formation and apply the Minimum Stress Equation to calculate pore pressure for the closure pressure estimated in Step 200. For example, the pore pressure is calculated by applying Eq. 1, which is the general Minimum Horizontal Stress Equation. The closure pressure is equivalent to minimum horizontal stress, denoted as $\sigma_{h,min}$. Accordingly, the pore pressure, denoted as Pp, is calculated by solving Eq. 1 below based on the determined value of closure pressure, i.e., minimum horizontal stress $\sigma_{h,min}$.

$$\sigma_{h,min} = \frac{v}{1-v} \times (\sigma_v - \alpha P_p) + \alpha P_p + P_{Tectonic} \quad \text{Eq. 1}$$

The symbols appearing in Eq. 1 are defines as:

v=Poisson's ratio calculated from logs $\sigma_v$=Vertical stress (psi) determined for the area if interest α=Biot's constant calculated from logs $P_p$=Pore Pressure, psi $P_{Tectonic}$=Tectonic pressure (psi) determined for the area if interest Unlike petrophysical and geomechanical logs, DFIT is an injection test that is used to estimate closure pressure at a pre-defined depth (single pressure point estimation. Closure pressure=minimum horizontal stress at that depth). On the other hand, petrophysical tools are run after drilling to estimate rock properties such as Gama Ray, density log, sonic log, caliper log, resistivity log . . . etc. Consequently, several petrophysical and geomechanical properties of the formation can be estimated/calculated such as porosity, water saturation, Poisson's ratio, Young Modulus, Biot's constant . . . etc). Those basic parameters are known for the area of interest (field or well location), and by estimating closure pressure from the DFIT which is equivalent to minimum horizontal stress, the pore pressure can be calculated using the Eq. 1.

In Step 202, pressure decline data is used to generate the Horner plot where recorded decline pressure is plotted with respect to superposition time. Multiple interval times are selected from the Horner plot after closure pressure to estimate Horner pressure and permeability. In one or more embodiments, a table of estimated permeability versus estimated pressure is generated based on recorded decline pressures at different time intervals in the DFIT dataset. To generate this table, a Horner plot is constructed by plotting the recorded decline pressure in the DFIT dataset with respect to corresponding time interval after fracture closure, along a log time scale referred to as the superposition time $$\left(\frac{t_p + \Delta t}{\Delta t}\right).$$

In the Horner plot, the superposition time is defined as $$\left(\frac{t_p + \Delta t}{\Delta t}\right)$$

where $t_p$ denotes injection time and Δt denoted the time interval from $t_p$ onwards for each declining pressure point.

Figure 3C:
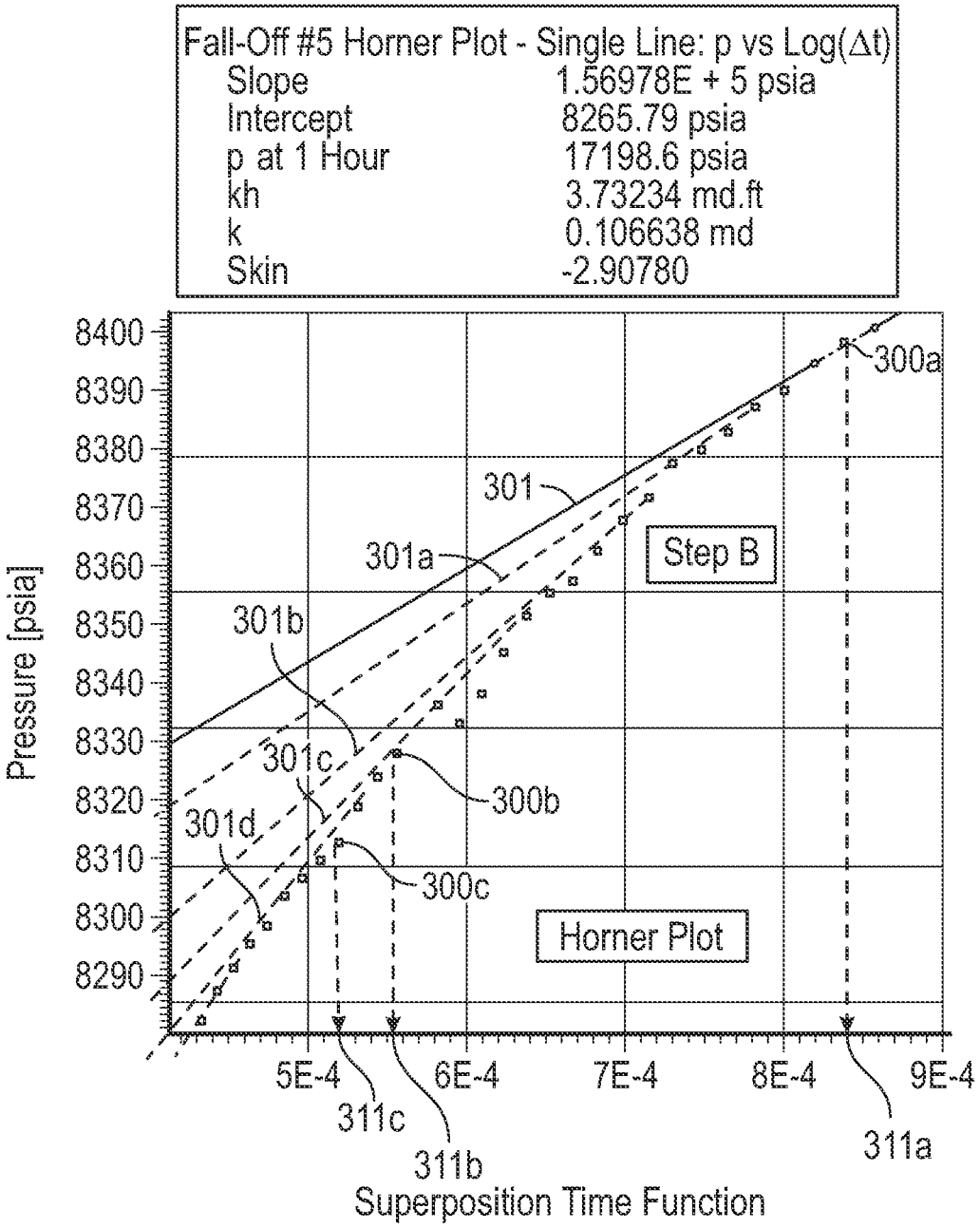

FIG. 3C shows an example Hornet plot where recorded decline pressures (e.g., 300*a*, 300*b*, 300*c*) are plotted along the vertical axis Y with respect to corresponding time intervals (e.g., 311*a*, 311*b*, 311*c*) along the horizontal axis X in the superposition time scale. For different time intervals (e.g., 311*a*, 311*b*, 311*c*) in the Horner plot, after fracture closure, Horner analysis is applied to estimate the pressure and permeability values at each time interval. For each time interval, a tangent line (301*a*, 301*b*, 301*c*, 301*d*) is generated where the intercept with Y-axis is the estimated pressure (P*) and the slope of the tangent line is used to estimate the permeability from the linear equations below:

$$Pws\,(\text{Shut-in Presure decline in Y-axis}) = P^* + m\left[\log\left(\frac{tp+\Delta t}{\Delta t}\right)\right] \quad \text{Eq. 2}$$

$$m = \left|\frac{162.6\ qinjB\,\mu}{kh}\right| \quad \text{Eq. 3}$$

In Eq. 2 and Eq. 3, m denotes slope, qinj denotes injection rate, B denotes formation volume factor for formation fluid, μ denotes formation fluid viscosity, h denotes pay thickness and k denotes permeability.

The time intervals (311*a*, 311*b*, 311*c*) for the Horner analysis starts from the first cycle after closure analysis, taking 1 or 2 points per additional cycle of the data available. This generates a table (e.g., TABLE 1) of estimated permeability versus estimated pressure. Each pair of estimated permeability and estimated pressure generated from the Horner analysis and included in this table is referred to as a tabulated data entry.

TABLE 1

| #Time Interval | P*, psi | k, ηD |
|---|---|---|
| 1 | 8265.79 | 74646 |
| 2 | 8230.46 | 58702.4 |
| 3 | 8204.59 | 49945.2 |
| 4 | 8179.59 | 43314.8 |
| 5 | 8155.43 | 37546.8 |
| 6 | 8128.95 | 32407.2 |
| 7 | 8091.26 | 26284.2 |

FIG. 3C alone cannot be used to determine pore pressure and permeability as the radial flow is not reached in nano-Darcy rock. In one or more embodiments, the tabulated data in TABLE 1 is used to understand the trend of permeability at different pressures. By plotting the data and extrapolating the curve to pore pressure (static condition), the true matrix permeability of the formation is estimated.

In Step 203, based on the tabulated data entries of estimated permeability versus estimated pressure, the trend line (301) is extrapolated to the determined pore pressure to obtain the permeability/transmissibly at static conditions of the reservoir. In particular, by plotting the tabulated data and generating the exponential curve, the curve can be extrapolated to the pore pressure that was estimated earlier from Eq.1 to find permeability at static condition. The permeability at static reservoir condition will be equivalent to permeability at radial flow regime.

In Step 204, true (matrix) reservoir permeability is estimated or otherwise determined by extrapolating the tabulated data entries generated by the Horner analysis in Step 202. Specifically, the tabulated data entries are extrapolated, in accordance with a nonlinear correlation, to the reservoir pressure to estimate the true reservoir permeability.

The estimate permeability in the tabulated data are calculated at different phases of pressure decline, which are an overestimated permeability value as the pressure continues to drop. These values are not the true contribution of the reservoir permeability and hence, considered overestimates and unreliable. By having a tabulated estimated permeability values at each pressure decline point, a trend is established and extrapolated to the original reservoir permeability. The true matrix permeability is the extrapolated permeability value at static conditions (original reservoir conditions) after the effect of injection pressure dissipates completely into formation (equivalent to radial flow conditions).

As noted above, the radial flow regime is excluded from the DFIT dataset and therefore necessarily excluded from the tabulated data entries. Accordingly, the radial flow regime is excluded from determining the true reservoir permeability. In other words, the true reservoir permeability is determined prior to any radial flow regime is reached in the formation zone.

The results of reservoir permeability and pressure described above are main inputs for fracturing, production, and reservoir modeling to develop area of interest for performing field operations. In case of a vertical well, several sections can be tested using the DFIT such that the landing of horizontal well can be determined based on the result of the workflow described above.

Figure 3D:
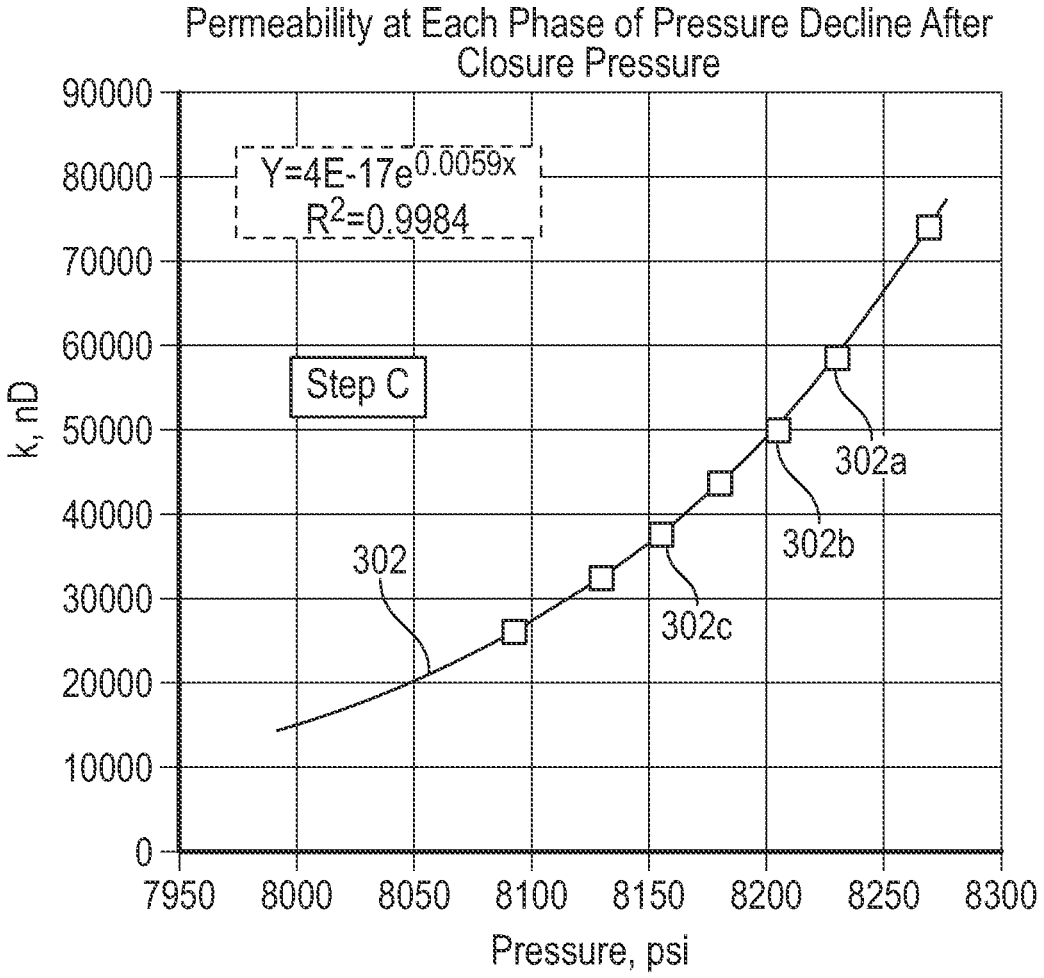

FIG. 3D shows the extrapolated curve (302) based on the tabulated data entries (302*a*, 302*b*, 302*c*) of estimated permeability versus estimated pressure generated in Step 202. The extrapolated curve (302) represents the nonlinear (e.g., an exponential function) correlation between the estimated permeability and the estimated pressure in the tabulated data entries (e.g., 302*a*, 302*b*, 302*c*). In comparison, the recorded pressure decline range in FIG. 3C is 8290-8400 while the pressure range estimated from Horner analysis (P*) of the tabulated data entries (302*a*, 302*b*, 302*c*) in FIG. 3D is 8150-8200.

In Step 205, a determination is made as to whether to perform the DFIT for another formation zone. If the determination is positive, i.e., the DFIT is to be performed for another formation zone, the method returns to Step 200. If the determination is negative, i.e., no more DFIT is to be performed, the method proceeds to Step 206.

In Step 206, a ranking of all formation zones where the DFIT has been performed is generated based on the respective reservoir permeabilities determined in Step 204. In other words, the formation zone having a higher ranking indicates that the formation zone has a higher permeability.

In Step 207, one or more target formation zone is selected from all the formation zones based on the ranking generated in Step 206.

In Block 208, a field production of the unconventional reservoir is performed based at least on the reservoir permeability of the target formation zone. In some embodiments, the field operation includes a hydraulic fracturing operation or an EOR production operation to extract hydrocarbons from the target formation zone.

Figure 4:
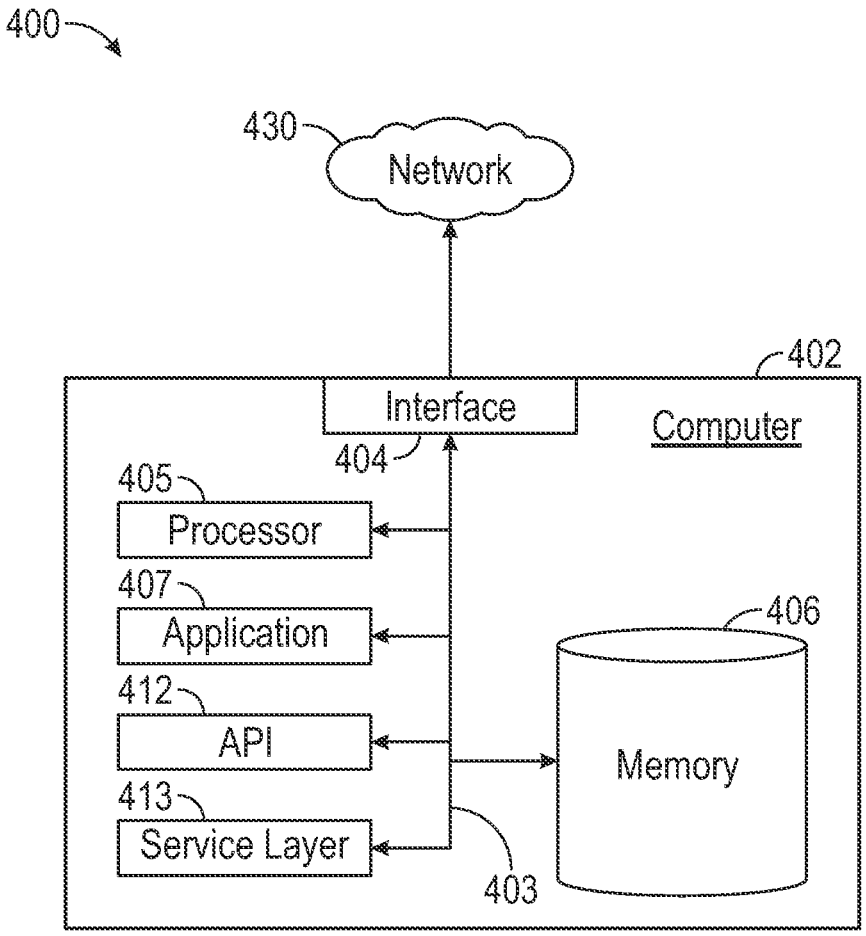
FIG. 4 shows a computing system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, the application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method to perform a field operation of an unconventional reservoir, comprising:

performing a diagnostic fracture injection test (DFIT) of a formation zone in the unconventional reservoir to generate a DFIT dataset, wherein each entry of the DFIT dataset comprises a decline pressure and a time interval that are measured prior to any radial flow regime occurs in the formation zone during the DFIT, wherein the formation zone is one of a plurality of formation zones in the unconventional reservoir;

selecting, from a collection of the time interval of each entry of the DFIT dataset, a plurality of time intervals;

analyzing the DFIT dataset at the plurality of time intervals to generate tabulated entries of estimated permeability versus estimated pressure in the tabulated entries;

determining, prior to said any radial flow regime occurs in the formation zone during the DFIT, a true reservoir permeability in the formation zone by extrapolating the tabulated entries of estimated permeability versus estimated pressure;

generating, according to the true reservoir permeability in each of the plurality of formation zones, a ranking of the plurality of formation zones;

selecting, from the plurality of formation zones and based on the ranking, a target formation zone having the true reservoir permeability meeting a pre-determined criterion; and performing, based at least on the true reservoir permeability of the target formation zone, the field operation of the unconventional reservoir, wherein the field operation comprises a hydraulic fracturing operation or an enhanced oil recovery process.

2. The method of claim 1, further comprising:

generating a nonlinear correlation between the estimated permeability and the estimated pressure in the tabulated entries, wherein extrapolating the tabulated entries of estimated permeability versus estimated pressure is based on the nonlinear correlation, and wherein analyzing the DFIT dataset at the plurality of time intervals is based on using Horner analysis to generate the tabulated entries of estimated permeability versus estimated pressure.

3. The method of claim 1, further comprising:

determining, based on a closure pressure of the DFIT dataset and using a minimum horizontal stress equation, a pore pressure of the target formation zone, wherein performing the field operation of the unconventional reservoir is further based at least on the pore pressure of the formation zone of the target formation zone.

4. The method of claim 1, further comprising:

determining, based on an extrapolated trend line in the tabulated entries of estimated permeability versus estimated pressure, a static condition permeability of the target formation zone, wherein performing the field operation of the unconventional reservoir is further based at least on the static condition permeability of the target formation zone.

5. The method of claim 1, wherein the true reservoir permeability in the formation zone is less than one nano-Darcy, wherein no radial flow regime occurs in the formation zone prior to one week from a beginning of the DFIT, and wherein the true reservoir permeability in the formation zone is determined within one week from the beginning of the DFIT.

6. A pore pressure and permeability analysis system to facilitate a field operation of an unconventional reservoir, comprising:

a computer processor; and memory storing instructions, when executed by the computer processor comprising functionality for:

performing a diagnostic fracture injection test (DFIT) of a formation zone in the unconventional reservoir to generate a DFIT dataset, wherein each entry of the DFIT dataset comprises a decline pressure and a time interval that are measured prior to any radial flow regime occurs in the formation zone during the DFIT, wherein the formation zone is one of a plurality of formation zones in the unconventional reservoir;

selecting, from a collection of the time interval of each entry of the DFIT dataset, a plurality of time intervals;

analyzing the DFIT dataset at the plurality of time intervals to generate tabulated entries of estimated permeability versus estimated pressure;

determining, prior to said any radial flow regime occurs in the formation zone during the DFIT, a true reservoir permeability in the formation zone by extrapolating the tabulated entries of estimated permeability versus estimated pressure;

generating, according to the true reservoir permeability in each of the plurality of formation zones, a ranking of the plurality of formation zones;

selecting, from the plurality of formation zones and based on the ranking, a target formation zone having the true reservoir permeability meeting a pre-determined criterion; and performing, based at least on the true reservoir permeability of the target formation zone, the field operation of the unconventional reservoir, wherein the field operation comprises a hydraulic fracturing operation or an enhanced oil recovery process.

7. The pore pressure and permeability analysis system of claim 6, the instructions, when executed by the computer processor further comprising functionality for:

generating a nonlinear correlation between the estimated permeability and the estimated pressure in the tabulated entries, wherein extrapolating the tabulated entries of estimated permeability versus estimated pressure is based on the nonlinear correlation, and wherein analyzing the DFIT dataset at the plurality of time intervals is based on using Horner analysis to generate the tabulated entries of estimated permeability versus estimated pressure.

8. The pore pressure and permeability analysis system of claim 6, the instructions, when executed by the computer processor further comprising functionality for:

determining, based on a closure pressure of the DFIT dataset and using a minimum horizontal stress equation, a pore pressure of the target formation zone, wherein performing the field operation of the unconventional reservoir is further based at least on the pore pressure of the formation zone of the target formation zone.

9. The pore pressure and permeability analysis system of claim 6, the instructions, when executed by the computer processor further comprising functionality for:

determining, based on an extrapolated trend line in the tabulated entries of estimated permeability versus estimated pressure, a static condition permeability of the target formation zone, wherein performing the field operation of the unconventional reservoir is further based at least on the static condition permeability of the target formation zone.

10. The pore pressure and permeability analysis system of claim 6, wherein the true reservoir permeability in the formation zone is less than one nano-Darcy, wherein no radial flow regime occurs in the formation zone prior to one week from a beginning of the DFIT, and wherein the true reservoir permeability in the formation zone is determined within one week from the beginning of the DFIT.

11. A system comprising:

a well control system for performing a field operation of an unconventional reservoir; and a pore pressure and permeability analysis system comprising a computer processor and memory storing instructions, when executed by the computer processor comprising functionality for:

performing a diagnostic fracture injection test (DFIT) of a formation zone in the unconventional reservoir to generate a DFIT dataset, wherein each entry of the DFIT dataset comprises a decline pressure and a time interval that are measured prior to any radial flow regime occurs in the formation zone during the DFIT, wherein the formation zone is one of a plurality of formation zones in the unconventional reservoir;

selecting, from a collection of the time interval of each entry of the DFIT dataset, a plurality of time intervals;

analyzing the DFIT dataset at the plurality of time intervals to generate tabulated entries of estimated permeability versus estimated pressure;

determining, prior to said any radial flow regime occurs in the formation zone during the DFIT, a true reservoir permeability in the formation zone by extrapolating the tabulated entries of estimated permeability versus estimated pressure;

generating, according to the true reservoir permeability in each of the plurality of formation zones, a ranking of the plurality of formation zones;

selecting, from the plurality of formation zones and based on the ranking, a target formation zone having the true reservoir permeability meeting a pre-determined criterion; and performing, based at least on the true reservoir permeability of the target formation zone, the field operation of the unconventional reservoir, wherein the field operation comprises a hydraulic fracturing operation or an enhanced oil recovery process.

12. The system of claim 11, the instructions, when executed by the computer processor, further comprising functionality for:

generating a nonlinear correlation between the estimated permeability and the estimated pressure in the tabulated entries, wherein extrapolating the tabulated entries of estimated permeability versus estimated pressure is based on the nonlinear correlation, and wherein analyzing the DFIT dataset at the plurality of time intervals is based on using Horner analysis to generate the tabulated entries of estimated permeability versus estimated pressure.

13. The system of claim 11, the instructions, when executed by the computer processor, further comprising functionality for:

determining, based on a closure pressure of the DFIT dataset and using a minimum horizontal stress equation, a pore pressure of the target formation zone, wherein performing the field operation of the unconventional reservoir is further based at least on the pore pressure of the formation zone of the target formation zone.

14. The system of claim 11, the instructions, when executed by the computer processor, further comprising functionality for:

determining, based on an extrapolated trend line in the tabulated entries of estimated permeability versus estimated pressure, a static condition permeability of the target formation zone, wherein performing the field operation of the unconventional reservoir is further based at least on the static condition permeability of the target formation zone.

15. The system of claim 11, wherein the true reservoir permeability in the formation zone is less than one nano-Darcy, wherein no radial flow regime occurs in the formation zone prior to one week from a beginning of the DFIT, and wherein the true reservoir permeability in the formation zone is determined within one week from the beginning of the DFIT.

* * * * *